United States Patent [19]

Stein, Jr. et al.

[11] 3,959,859

[45] June 1, 1976

[54] CASKET CAP BRACE

[75] Inventors: Joseph A. Stein, Jr., Greensburg; Carl A. Wettering, Batesville, both of Ind.

[73] Assignee: Batesville Casket Company, Batesville, Ind.

[22] Filed: Sept. 23, 1974

[21] Appl. No.: 508,412

[52] U.S. Cl. ..... 27/18; 217/60 C; 292/338

[51] Int. Cl.[2] ..... A61G 17/00

[58] Field of Search ..... 27/1, 6, 9, 14–19, 27/DIG. 1; 16/82, 178, 191; 217/60 R, 60 A, 60 B, 60 C, 60 D; 248/351; 292/338

[56] References Cited

UNITED STATES PATENTS

| | | | |
|---|---|---|---|
| 1,188,895 | 6/1916 | Capps | 217/60 B |
| 1,267,451 | 5/1918 | Prettie | 217/60 C |
| 1,574,111 | 2/1926 | Rardon et al. | 27/16 |
| 1,590,040 | 6/1926 | Lamb | 217/60 B |
| 3,060,546 | 10/1962 | Nelson | 27/18 |
| 3,078,001 | 2/1963 | Young et al. | 292/338 |

FOREIGN PATENTS OR APPLICATIONS

| | | | |
|---|---|---|---|
| 1,912,949 | 1970 | Germany | 217/60 R |
| 212,082 | 1924 | United Kingdom | 217/60 C |
| 376,927 | 1932 | United Kingdom | 217/60 C |
| 841,103 | 1960 | United Kingdom | 217/60 C |

*Primary Examiner*—John D. Yasko
*Attorney, Agent, or Firm*—Haight, Hofeldt, Davis & Jambor

[57] ABSTRACT

A brace for rigidly locking a casket cap in its open position to positively preclude movement of the cap about its pivotal connection with the casket body in either direction. The brace includes an elongated member pivotally mounted in a support bracket carried by the casket body and transversely displaced from the hinge for the casket cap. This elongated member then extends generally upward through an elongated slot in the casket cap which telescopes outwardly over the member as the cap is pivoted from the closed position to the open position. When the cap reaches the open position, cooperating locking means on the cap and the end of the elongated member engage to lock the cap in the open position. The locking means precludes further pivotal movement of the cap in either direction until the locking means is released. Resilient biasing means maintain the locking engagement and facilitate its release.

12 Claims, 7 Drawing Figures

16
18
20
50
15
10
14
12

83
82
80
86

50
16
12

62
63
64
83
58
66
80
18
56
50
14
15
36
46
48
32
42
52

F
50
16
12
84
80
84
86
82
58
59
56

50

50
16
12
48
30
34
49
36
49
51
43
32
42
44
46
44
52

CASKET CAP BRACE

BACKGROUND OF THE INVENTION

The caps or cover panels of burial caskets are large and quite heavy. At funeral services and on other occasions, this cap must be supported in a substantially vertical or open position to permit observation of the deceased. For this purpose, a casket cap brace or support is used. Accordingly, the brace should have several desirable characteristics. It must stabilize and rigidly lock the top panel in its generally vertical position against pivotal movement in either direction relative to the casket body. Further, the brace must be small in size to avoid interference with gaskets utilized to positively seal the casket upon closing. Too, aesthetics are an important characteristic. The brace must be attractive, avoid visual obstruction of the body, and emit no undesirable sound.

SUMMARY OF THE INVENTION

In order to achieve the above-mentioned characteristics for a casket cap brace, the instant invention comprises a simple elongated member pivotally carried by the casket body and adapted to extend upwardly into the casket cap through a slot therein. Upon the upper end of this member is formed a locking structure which cooperates with the slot in the casket cap when the latter reaches the open position to prevent further movement of the cap. Further, the elongated member has a lower end which extends down into and compresses an elastomeric abutment carried in the interior of the casket body. The expansion force exerted on the brace maintains the locking structure in engagement and facilitates its release. Additionally, the slot in the casket cap is lined with a plastic insert having a slot therein with edges appropriately formed to cooperate with the locking structure of the elongated brace member.

Accordingly, it is an object of this invention to provide a casket cap brace which incorporates some or all of the desirable characteristics previously identified. It is a further object of this invention to provide a brace member formed of a single, elongated, stamped metal piece having substantial strength. A further object is to provide a casket cap brace of low cost, facilitating installation on a casket and having a pleasing appearance. Finally, it is an object of this invention to provide a casket cap brace which automatically locks the cap in the open position and facilitates unlocking for closing the casket. Additionally, the unit avoids the emission of undesirable sound.

DESCRIPTION OF THE DRAWINGS

The manner in which these and other objects of the invention are obtained will be made clear by the following specifications and drawings in which.

DETAILED DESCRIPTION

Figures 1, 2, 3, 4, 5, 6, 7:
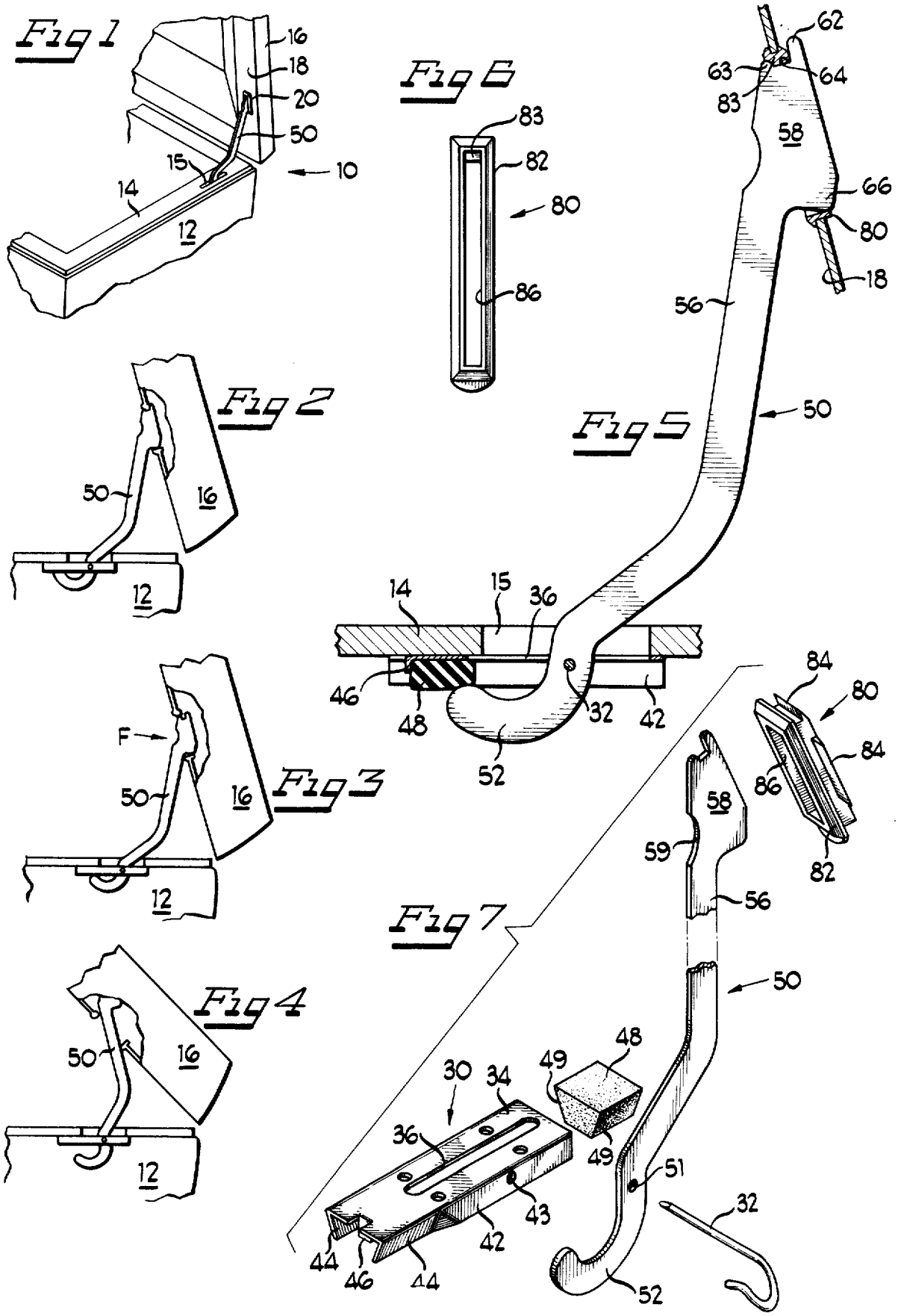
FIG. 1 is a perspective view of a portion of the casket depicting a preferred embodiment of the invention as installed.
FIG. 2 is a side elevational view of the casket with portions broken away to depict a preferred embodiment of the instant invention in its locking position.
FIG. 3 is a view similar to that of FIG. 2, depicting the manner of unlocking the brace.
FIG. 4 is a view similar to that of FIG. 3 depicting the closing of the casket cap.
FIG. 5 is a side elevational view of the preferred embodiment of our invention.
FIG. 6 is a side elevational view of the locking insert of our invention.
FIG. 7 is an exploded perspective view of the preferred embodiment of our invention.

As shown in FIG. 1, the preferred embodiment of our invention has primary application to a burial casket 10. Such devices include a lower body portion 12 for receiving a corpse and a cap or top panel 16 pivotally connected to the body portion 12 by hinges (not shown) for closing and sealing the casket body portion 12. Mating horizontal flanges 14 and 18 extend inwardly from the side walls of the body portion 12 and the cap 16, and such is normally provided with a gasket to seal the casket upon closing.

However, prior to burial, the casket is normally held open during funeral services to permit viewing of the deceased. The instant invention is utilized to position and hold the cap 16 in a generally vertical position for this purpose. Preferably, a separate brace is used at each end of the casket, but since they are identical only one is shown in FIG. 1.

The details of our invention can best be described by reference to FIGS. 5 and 6. It comprises three basic components which include a bracket 30, an elongated support member 50 and an insert 80. In installation, the bracket 30 is riveted to the underneath side of flange 14 adjacent the aperture or slot 15 formed in the flange. The elongated brace member then extends through slot 15 and a slot 36 in the bracket 30 and is pivotally attached to the bracket by a pin 32. This member then extends upward through a slot 20 formed in the flange 18. Cooperative locking means on the end of member 50 and on an insert 80 carried by flange 18 then lock the top panel 16 in the open position. As subsequently described, an elastomeric abutment 48 holds the locking means engaged until the unit is to be closed.

Considering now each of these components in detail, the bracket 30 is generally U-shaped in cross-section having a top 34, and downwardly depending flanges 42. In the top 34 of the bracket is formed an elongated slot 36 which receives member 50. As shown, apertures in the top 34 permit the bracket to be riveted to the underneath side of flange 14 such that slot 36 is generally in juxtaposition with slot 15 of flange 14. The flanges 42 at their forward end of bracket 30 are turned inwardly as indicated at 44 to form a retaining device for an elastomer bumper 48, whose side walls are also turned inwardly as at 49. To complete the retainer, a flange 46 is formed at the front of bracket 30. In assembly, the abutment 48 is first inserted into the retaining flanges and the bracket is riveted to flange 14.

After the bracket 30 is attached to flange 14, the lower end of brace member 50 is inserted through slot 36. Then a pivot pin 32 is inserted through apertures 43 of flange 42 and aperture 51 of member 50. Such permits pivotal movement of member 50 through a vertical plane passing through slot 36.

The upper end of member 58 extends through a slot 20 of the flange 18 of top member 16. Preferably, this slot carries a plastic molded insert 80 having exterior and interior flanges 82 and 84 for engaging opposite sides of the flange 18.

This insert 80 and the end of member 50 are formed with cooperative locking means which are automatically engaged when the cap 16 is opened to the vertical position. As viewed in FIG. 5, the top section of member 50 takes the shape of a foot 58 having a heel or lower projection 66 and an upper toe or projection 62. As shown, the distance between projections 62 and 66 is greater than the length of slot 86. Thus, the cap 16 can be pivoted clockwise about its hinges to the position generally shown in FIG. 5 in which a recess 64 formed between projections 62 and 63 in section 56 receives a downwardly extending lip 83 formed in insert 80. The rearward surface of member 50 and the projection 66 sliding in the bottom portion of slot 86 cams the section 56 upwardly to urge the recess 64 into engagement with lip 83. Upward projection 63 opposes the tendency of the cover to cam member 50 clockwise and close. However as shown in FIG. 5, to lock the cap 16 in the open position, the lip 83 must pass over this projection 63. This is accomplished by pivoting the cap 16 clockwise a small distance beyond the position shown in FIG. 5. Since the pivot of the member 50 is transversely displaced from the pivot (not shown) of cap 16 further clockwise movement of cap 16 raises lip 84 relative to projection 63 and the lip enters the recess 64. It should be noted that the heel or projection 66 does not enter the slot 86 even though the lip 83 is seated in recess 64. Due to its shape, further clockwise movement of cap 16 will cam the recess 64 tighter against lip 83. Thus, upon opening of the top panel 16, the brace is effectively engaged.

To retain the brace in the locked position, a resilient bias is applied to member 56. This member extends below pivot pin 32 in the shape of a curved arm 52 whose end abuts the rubber bumper 48. Thus when the cap 16 is in the open position, the arm 52 should partially compress abutment 48 and its expansion force urges the member 50 counterclockwise resulting in a tighter engagement between recess 64 and lip 83. Accordingly cap 16 is rigidly held against pivotal movement in either direction.

To release the brace member 50, it is rotated slightly clockwise as shown in FIG. 3 by applying a force F to the indentation 59. This pressure further compresses abutment 48, and the clockwise force causes section 56 to move inwardly of cap 16. This occurs because clockwise rotation of member 50 diminishes the height of projection 63 relative to lip 83 of the insert. Upon release, cap 16 may be closed while member 50 telescopes into the slot 86 and the cap as shown in FIG. 4. The casket is then locked for burial.

Our invention may take various forms. For example, the bracket may be formed integrally with the casket body and the elastomeric abutment may be attached by various other means. Alternatively the resilient force applied to member 52 can be exerted by a spring bias or applied at a different position. Finally, the brace support here disclosed may be used to support other panels pivotally attached to other compartments.

We claim:

1. An improved casket cap brace support for supporting the pivotally mounted cap of a casket body in its open position, said support comprising:

a. a support bracket adapted to be affixed to the casket body, said bracket having an aperture therethrough adapted to vertically receive a pivotal brace member;

b. an elongated slot in said casket cap positioned above said support bracket;

c. an elongated brace member extending through said aperture in said support bracket and attached thereto for pivotal movement in a vertical plane, said member extending through and slidable within said slot in said casket cap; and d. said brace member having an enlarged section at its extended end defining a recess formed by two projections for engaging one end of said elongated slot and vertically supporting said cap in the open position, said section also defining a third projection simultaneously engaging the opposite end of said slot for camming said recess into receiving relation with said one end and for locking said cap against movement is either direction when the cap is raised to its open position.

2. An apparatus as recited in claim 1 in which said casket carries an elastomeric abutment for engaging and biasing said recess of said brace member into engagement with said one end of said elongated slot.

3. An apparatus as recited in claim 2 in which said brace member extends from its pivotal attachment to said support bracket, and said abutment is affixed on said casket body adjacent the extension of said brace member.

4. In a casket having casket body and a cap pivotally attached thereto, said body and said cap having an inwardly extending flange carrying sealing means for sealing said casket, an improved casket cap brace for locking said cap in an open position, said brace comprising:

a. a rigid elongated member pivotally connected to said body for pivotal movement thereon, said member extending from said pivotal connection through the flange of said casket cap and into said body;

b. insert means carried by said flange of said cap and having a slot therein for receiving said elongated member;

c. said insert and said elongated member having cooperative locking means for rigidly locking said cap in an open position against pivotal movement in at least one direction; and d. an elastomeric abutment carried by said body for engaging the extension of said elongated member and for biasing and retaining said locking means in engagement.

5. An apparatus as recited in claim 4 in which said cooperative locking means comprises an enlarged section on said elongated member having a first recess for engaging one end of the slot in said insert and a projection for engaging the other end of said slot and for camming said recess against the one end of said slot.

6. An apparatus as recited in claim 4 in which said cooperative locking means comprises: an enlarged section having a length greater than that of said slot; a recess formed by two projections for engaging said insert at one end of said slot; and a projection for engaging the other end of said slot and for camming said recess engaging relationship with said one end of said insert.

7. A support brace for supporting a cover panel pivotally attached to a compartment comprising:

a. a slot in said cover panel transversely displaced from said pivotal attachment of said panel to said compartment;

b. an elongated member pivotally attached to said compartment at a position generally below said aperture of said cover panel when the latter is closed;

c. said elongated member telescoping into said slot and having an enlarged section on its outer end of a greater dimension than said slot for preventing said panel from opening an undesirable distance; and d. said enlarged section having a recess formed by two projections for engaging one end of said slot and a third projection simultaneously engaging the other end of said slot for camming said recess into engagement with said one end of said slot and supporting said panel in an open position.

8. An apparatus as recited in claim 7 in which a resilient means is carried by said compartment for holding said recess in engagement with said one end of said slot.

9. An apparatus as recited in claim 8 in which said slot carries an injected molded insert for engaging said recess.

10. An apparatus as recited in claim 9 in which said elongated member extends below its pivotal attachment and said resilient means applies an expansion force to said extension to maintain said recess in engagement with said slot.

11. In a casket having a casket body and a pivotally mounted top, an improved brace support for locking said top in a generally vertical position, said brace support comprising:

a. a support bracket mounted on said casket body transversely from the pivotal connection of said top and said casket body;

b. a flat elongated member pivotally mounted in said support bracket and extending into said top;

c. a receiving insert having an elongated slot carried by said cap for receiving said elongated member, said insert generally positioned above said support bracket, said slot camming said member for rotational movement in the same direction as the cap is rotated;

d. an enlarged section on said elongated member having a dimension greater than that of said slot for limiting opening movement of said cap;

e. a projection on said enlarged section which is sufficiently small to pass through said slot upon opening of said cap, but engaging one end of said cap for supporting same against rotational movement in the opposite direction; and f. biasing means carried by said body for biasing said projection into supporting relation with one end of said slot.

12. A support brace for supporting a cover panel member pivotally attached to a compartment member comprising:

a. a slot in one of said members transversely displaced from said pivotal attachment;

b. a rigid elongated element pivotally attached to said other member intermediate the ends of said element, one end of said element extending into said slot and having an enlarged section to prevent the element from telescoping out of said slot, the other end extending into said other member;

c. said enlarged section having a detent thereon for engaging at least one end of said slot when the cover member is moved to an open position; and d. an elastomeric abutment carried by said other member for engaging the other end of said element and for resiliently biasing said detent into engagement with said slot.

* * * * *